US006273072B1

(12) United States Patent
Knapstein et al.

(10) Patent No.: US 6,273,072 B1
(45) Date of Patent: Aug. 14, 2001

(54) FUEL SYSTEM APPARATUS AND METHOD

(76) Inventors: Paul E. Knapstein, 3100 Canal Rd., Lake Wales, FL (US) 33853; Kent L. Jones, 116 Powell Ave., Cotter, AR (US) 72626

( * ) Notice: Subject to any disclaimer, the term of this patent is extended or adjusted under 35 U.S.C. 154(b) by 0 days.

(21) Appl. No.: 09/500,552

(22) Filed: Feb. 9, 2000

(51) Int. Cl.[7] ..... F02M 17/28; F02G 5/00
(52) U.S. Cl. ..... 123/527; 123/524; 123/557
(58) Field of Search ..... 123/1 A, 3, 27 GE, 123/516, 524, 525, 527, 557, 533

(56) References Cited

U.S. PATENT DOCUMENTS

| | | | |
|---|---|---|---|
| 2,965,085 | 12/1960 | Kahler . | |
| 3,828,736 | 8/1974 | Koch . | |
| 3,877,450 | 4/1975 | Meeks . | |
| 3,977,365 | 8/1976 | Vierling et al. . | |
| 4,011,840 | 3/1977 | Forster . | |
| 4,068,639 | 1/1978 | Cook . | |
| 4,161,160 | 7/1979 | Hicks et al. . | |
| 4,167,920 | 9/1979 | Lepera et al. . | |
| 4,331,121 | 5/1982 | Stokes . | |
| 4,376,423 | 3/1983 | Knapstein . | |
| 4,444,158 * | 4/1984 | Yoon | 123/1 A |
| 4,519,356 | 5/1985 | Sarich . | |
| 4,554,945 | 11/1985 | McKay . | |
| 4,681,071 | 7/1987 | Smith . | |
| 5,092,303 | 3/1992 | Brown . | |
| 5,215,063 | 6/1993 | Yeh . | |
| 5,245,974 | 9/1993 | Watson et al. . | |
| 5,829,417 | 11/1998 | Nyffenegger . | |
| 6,189,516 * | 2/2001 | Hei Ma | 123/524 |

* cited by examiner

*Primary Examiner*—Noah P. Kamen
*Assistant Examiner*—Hai Huynh
(74) *Attorney, Agent, or Firm*—William M. Hobby, III

(57) ABSTRACT

A combustion engine fuel system apparatus saturates and diffuses a gas, such a air, into a liquid fuel. The apparatus includes a fuel saturation chamber connected to the engine fuel tank for receiving a liquid fuel therefrom and also connected to a gas compressor for directing compressed gas into the fuel saturation chamber for saturating a liquid fuel being fed therein with the gas. The fuel saturation chamber is connected to a gas diffusion chamber for diffusing gas into the liquid fuel and which is also connected to the gas compressor. A dense porous material, such as a porous stone, is positioned in the gas diffusion chamber for diffusing the gas and liquid fuel together. The saturation and diffused liquid fuel is then fed into a combustion engine. A liquid fuel heater is used to heat the fuel being fed into the fuel saturation chamber. The method includes heating a liquid fuel from a fuel tank then saturating the heated liquid fuel from a fuel supply tank with a gas and then directing the saturated fuel from the fuel saturating tank into a fuel diffusion chamber and diffusing a gas into the liquid fuel from the saturating chamber.

18 Claims, 2 Drawing Sheets

FUEL SYSTEM APPARATUS AND METHOD

BACKGROUND OF THE INVENTION

The present invention relates to a fuel system and especially to a fuel system for internal combustion and turbine and other engines which saturates and diffuses a gas, such as air, into a liquid fuel.

In the past, a great variety of internal combustion engine fuel systems have been provided for use on internal combustion engines in vehicles. Typically, a hydrocarbon fueled engine might have a carburetor in which a liquid fuel is vaporized in a fixed or variable venturi as air from the atmosphere is fed through the venturi, drawing fuel vapor into the intake manifold and into the cylinders of the engine. Diesel engines more commonly provide a fuel injection system in which the fuel is injected directly into the combustion chamber under high pressure and does not use a spark to ignite the charge being injected into the cylinder. Typically, air has already been drawn into the cylinder and compressed at the time the fuel is injected thereinto. It is more common today to provide a fuel injection system for more conventional spark ignition internal combustion engines which work at a lower combustion chamber pressure in order to improve the efficiency of the engine.

The present invention is directed primarily at combustion engines, including diesel, turbine and spark ignited engines, which have fuel injection systems and provides for the saturation and diffusion of the liquid hydrocarbon fuel with oxygen or air under pressure through a fuel saturator and a fuel diffuser connected in tandem. The fuel diffuser requires a dense but slightly porous stone or other material which forces a gas under pressure into the liquid fuel. It has been common in the past to saturate liquids with gases, such as carbon dioxide, to form soda water or to increase the gas content in malt drinks, such as beer. Saturated liquids, however, have to be maintained under pressure until just prior to use. The present invention first saturates the liquid fuel and then utilizes a stone similar to the one used by brewers but which has been enclosed in a casing in order to increase the diffusion of the saturated liquid fuel with a gas.

Other prior art type systems include the use of various systems for bubbling air through a liquid fuel in order to vaporize the fuel as well as a variety of other circuits directed primarily at vaporizing the fuel by the passing of a gas therethrough. These systems do no attempt to saturate the liquid with a gas but rather to vaporize the liquid in the air and are used primarily in carburetor type fuel systems. It has also been known to feed gases into a carburetor at the same time the hydrocarbon fuel is being vaporized therein and various fuel additives have been added to fuels to modify the fuel being fed to the fuel system. An advantage of the present invention is that the hydrocarbon liquid fuel can be saturated with a number of gases which can then be used on a fuel injection system without the individual injectors being broken by air or another gas getting into the fuel injectors. That is, most fuel injectors on internal combustion engines will not operate if air gets trapped in the injectors, so that gases cannot normally be fed with a fuel through a fuel injected system of an engine. The fuel system can also be used to treat bulk fuels, such as coal slurry, without departing from the spirit and scope of the invention.

This invention is an improvement over prior U.S. Pat. No. 4,376,423 to Knapstein, one of the present inventors. In this prior patent, an apparatus and a method of saturating liquid fuel with air, oxygen, or another gas is provided for injecting into an internal combustion engine. The internal combustion engine is provided with a gas compressor or pump for compressing air or oxygen, which is directed into a fuel diffuser having a dense, porous material or stone therein and having a liquid hydrocarbon fuel being fed therethrough. Compressed gas is fed onto one side of the stone and is forced therethrough for diffusion into the liquid fuel, which is then fed into a fuel injection system of an internal combustion engine.

SUMMARY OF THE INVENTION

A combustion engine fuel system apparatus saturates and diffuses a gas, such a air, into a liquid fuel. The apparatus includes a fuel saturation chamber connected to a fuel supply tank for receiving a liquid fuel therefrom and also connected to a gas compressor for directing compressed gas into the fuel saturation chamber for saturating a liquid fuel being fed therein with the gas. The fuel saturation chamber is connected to a gas diffusion chamber for diffusing gas into the liquid fuel and which is also connected to the gas compressor. A dense porous material, such as a porous stone, is positioned in the gas diffusion chamber for diffusing the gas and liquid fuel together. The saturation and diffused liquid fuel is then fed into a combustion engine. A liquid fuel heater is used to heat the fuel being fed into the fuel saturation chamber. The method includes heating a liquid fuel from a fuel tank, then saturating the heated liquid fuel from the engine fuel tank with a gas and then directing the saturated fuel from the fuel saturating tank into a fuel diffusion chamber and diffusing a gas into the liquid fuel from the saturating chamber.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENTS

The present invention is for a method and apparatus for saturating and diffusing air or oxygen or the like with a liquid hydrocarbon fuel for a combustion engine.

Saturate and saturation are used herein to mean the process of saturating a liquid with a gas by charging or impregnating a gas, such as air or oxygen, into a liquid fuel. Diffusing and diffusion are used herein to mean the dissemination of air or oxygen within a liquid fuel. Both processes are used in tandem to more fully incorporate a gas within a liquid fuel in a manner that it will not separate in the internal combustion engine fuel injection system.

Figure 1:
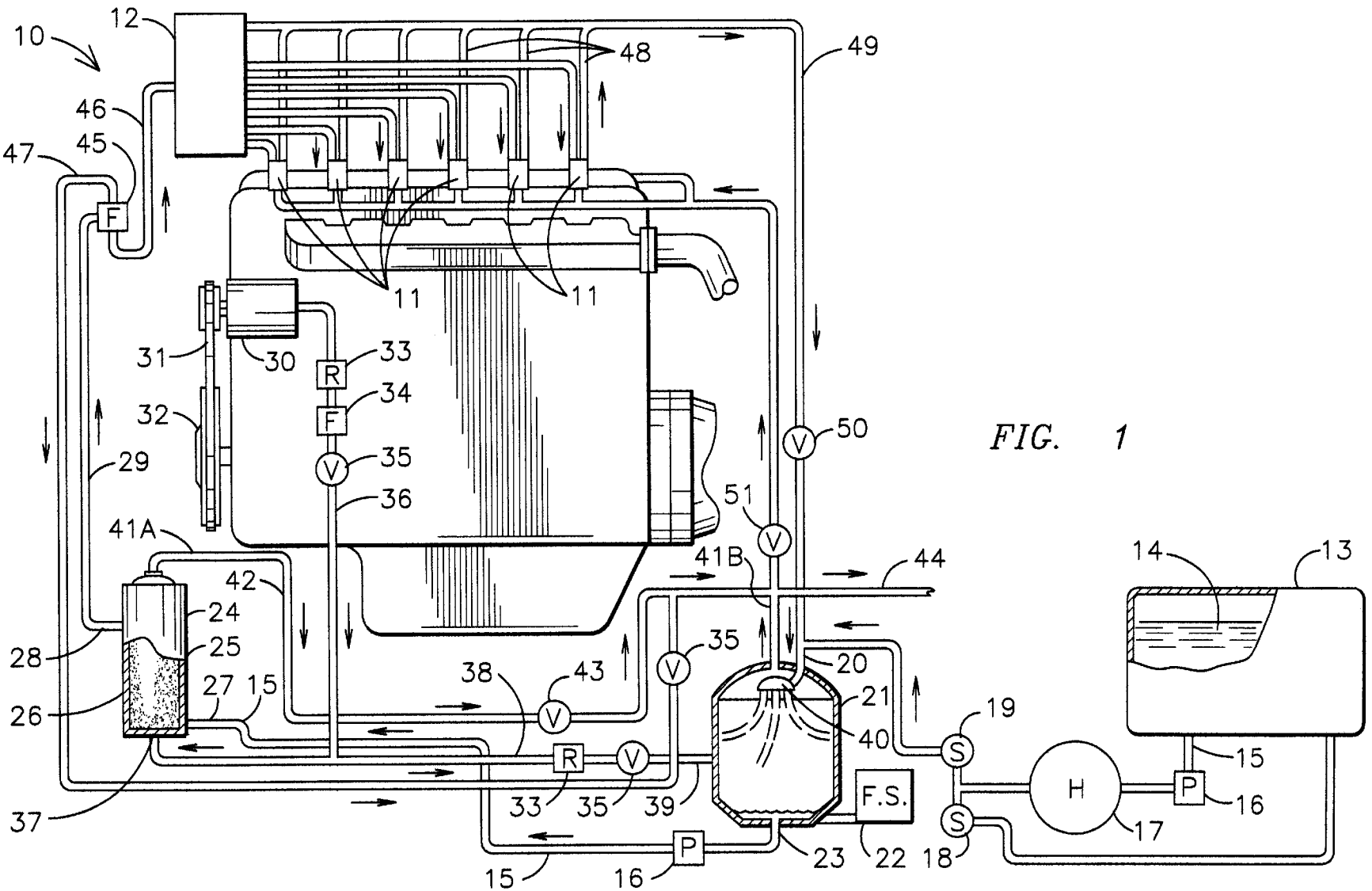
FIG. 1 is a diagrammatic view of the fuel system in accordance with the present invention attached to an internal combustion engine.
Figure 2:
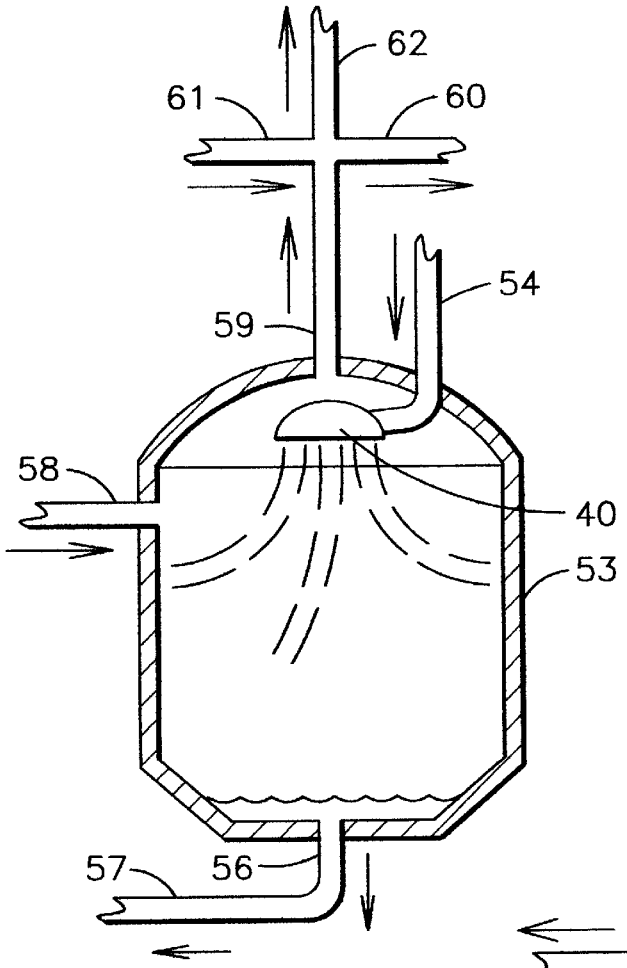
FIG. 2 is a sectional view of the fuel saturation chamber for use in FIG. 1.
Figure 3:
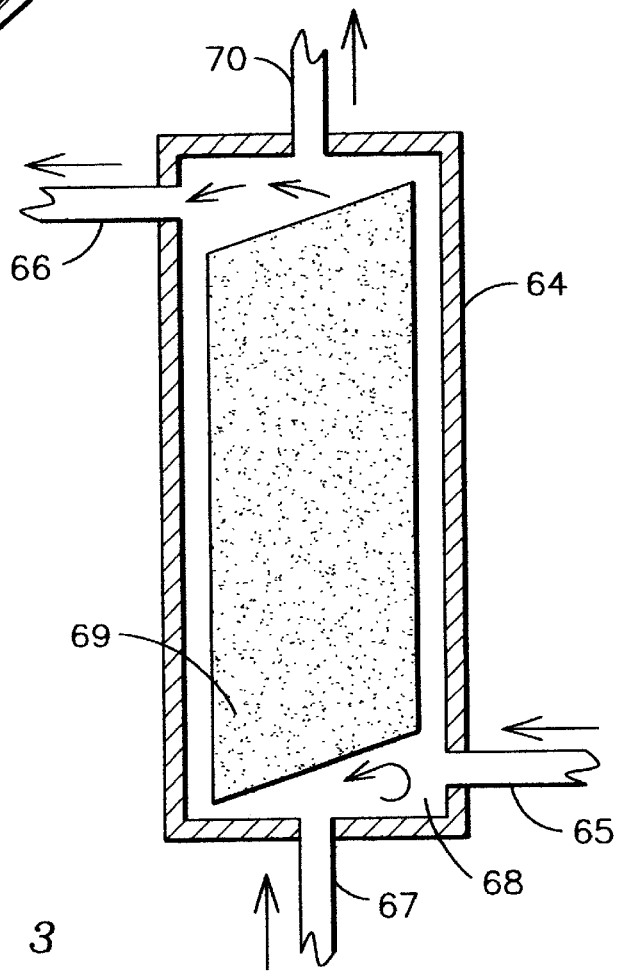
FIG. 3 is a sectional view of a fuel diffuser for use in the fuel system of FIG. 1.

Referring to the drawings, FIGS. 1 through 3, an internal combustion engine 10 is illustrated having a plurality of fuel injectors 11 which are of the conventional type used in a diesel or spark ignited internal combustion engine, and along with the injection pump 12, do not have to be changed in adapting the present invention to an existing engine.

The engine 10 is operated on a liquid fuel, such as No. 2 diesel fuel or other liquid hydrocarbon fuel, from the tank 13 having the fuel 14 fed therein. The fuel 14 is fed from the tank 13 through a fuel line 15 through a conventional fuel pump 16 and into the liquid fuel heater 17. The liquid fuel heater 17 may be an electrically heated fuel chamber. The fuel is pumped through the fuel heater 17 to shutoff valve 18 and shutoff valve 19 which are controlled by the float switch 22. When float switch 22 calls for makeup fuel, the shutoff valve 18 closes and valve 19 opens to allow makeup fuel to enter the saturator fuel inlet 20 and into the saturator canister 21. When the fuel saturator chamber 21 is full to capacity, valve 18 opens and allows fuel to return to the fuel tank 13.

The saturator canister 21 allows the saturated liquid fuel to collect in the bottom over the collection tube 23 where it is fed to a conventional fuel pump 16. The fuel pump 16 then pumps the saturated liquid fuel through a fuel line 15 to the diffuser chamber 24, the diffuser 24 has a container 25 and inside the casing is a dense, porous material 26, such as a brewers stone, which is shown in a cylindrical shape, but which is hollow. The fuel from the saturator container 21 is fed through line 15 into inlet 27 and into the container 25. The fuel flows into the container around the stone 26 and out of outlet 28 into a fuel line 29.

An air pump or air compressor 30 is attached to the internal combustion engine 10 and may be driven by a belt 31 attached to a pulley 32 connected to the crankshaft of the engine. Air from the atmosphere can be compressed in a compressor 30 and is fed through an air regulator 33 through an air filter 34 and through an in-line air check valve 35, through an air line 36 into the diffuser chamber 24 inlet 37 and into the inside of the dense, porous material 26. Under pressure, the air is forced through the dense, porous material 26 where it is forced into a liquid fuel therein on the opposite side of the porous material 26 to diffuse air into the liquid fuel. The compressed air line 36 is also connected to the air line 38 and into regulator 33 through an in-line air check valve 35 and fed therein to the saturator container 21 to saturate liquid fuel being fed from an outlet nozzle 40. The outlet nozzle 40 is shown with outlet streams but can be any number desired.

The fuel diffuser 24 has an outlet 41*a* from the top thereof and on in-line 42 attached thereto. An in-line air check valve 43 bleeds off the separated gas that separates it from the diffused fuel in the fuel diffuser 24 and is released through the vent line 44.

Saturated and diffused liquid fuel is fed from the fuel filter 45 through a fuel line 46 to the injector pump 12. The fuel filter 45 may have a gas line 47 connected thereto for removing any additional gas that has escaped from the diffused liquid fuel as it passes through a standard in-line air check valve 35 and is connected with the diffuser vent line 42 and the saturator vent line 41*b* to the vent line 44. The saturated and diffused liquid fuel fed through the line 46 into the injector pump 12 is injected into the fuel injectors in a conventional manner except that additional fuel bleed off lines 48 are connected to each fuel injector and each of these lines has the ability to bleed off excess fuel unused by the injector pump 12 and is connected to the fuel bleed off return line 49 which is connected to an in-line check valve 50 which is connected to the fuel inlet 20 which is connected to the fuel saturator container 21.

An in-line air check valve 35 is connected in the vapor return line 47 and in a similar check valve 43 and is connected in the vapor return line 42 and is connected to the main vent line 44 and may be vented and connected to the in-line air check valve 51 and connected to the line returned to the intake manifold lines 11 on certain engines to improve combustion and can enhance the combustion process by the use of gases other than air which would further enhance the combustion process.

The method of the present invention provides for feeding a liquid fuel to the fuel inlet 20 and to the fuel saturator container 21, compressing air or another gas in the compressor 30 and feeding it into the compressed gas inlet 39 and into the fuel saturator container 21. The liquid fuel from inlet 20 is directed into the saturator container 21 and into the mounted end nozzle 40 so that the fuel is saturated with the air or another gas and then collected in a collection tube 23 in the bottom of the saturator canister 21. The air saturated fuel is delivered through a conventional fuel pump 16 which pumps the saturated fuel through fuel line 15 to the newly added diffuser chamber 24 to one side of the dense, porous stone 26 while the fuel is being fed on the other side thereof.

The liquid fuel is saturated and diffused with air or another gas and injected into the engine and might also include the steps of bleeding off the excess gas release into an intake manifold or venting the air or gas out of the saturated and diffused fuel.

It should be clear at this point, that while air is shown being compressed, oxygen or any other gas could be diffused or saturated into the liquid fuel and that in place of the compressor 30, a small tank of compressed oxygen could be utilized without departing from the spirit and scope of the invention.

The system as illustrated is also shown connected to an internal combustion engine but it will be clear that any combustion fuel can be used for any combustion engine including the pretreating of bulk fuel, such as coal slurry, and can also be used with fuel oil for injection into furnaces or boilers.

Accordingly, the present invention is not to be construed as limited to the forms shown which are to be considered illustrative rather than restrictive.

What is claimed is:

1. A combustion engine fuel treatment apparatus comprising:

a fuel tank for holding a liquid fuel;

a gas compressor;

a fuel saturation chamber having a fuel inlet therein connected to said fuel tank for receiving a liquid fuel therefrom, said fuel saturation chamber also being connected to said gas compressor for directing gas under pressure into said fuel saturation chamber for saturating said liquid fuel with a gas;

a gas diffusion chamber for diffusing gas into said liquid fuel, said gas diffusion chamber being connected to said fuel saturation chamber for receiving saturated liquid fuel therefrom and to said gas compressor for receiving gas under pressure therefrom for diffusing gas into said liquid fuel; and means for directing liquid fuel saturated and diffused with gas from said gas diffusion chamber into a combustion engine; whereby liquid fuel saturated and diffused with a gas is used to operate a combustion engine.

2. A combustion engine fuel apparatus in accordance with claim 1 in which said gas diffusion chamber has dense, porous material therein having at least two sides for feeding a liquid on one side thereof and a pressurized gas on the other side thereof for diffusion said gas into said liquid.

3. A combustion engine fuel apparatus in accordance with claim 2 in which said gas diffusion chamber dense, porous material is a dense porous stone.

4. A combustion engine fuel apparatus in accordance with claim 2 including a liquid fuel heater connected between said fuel tank and said fuel saturation chamber for heating fuel being fed into said fuel saturation chamber.

5. A combustion engine fuel apparatus in accordance with claim 2 in which said fuel saturation chamber inlet has a nozzle mounted thereto and being positioned for said entering liquid fuel to be sprayed into said fuel saturator chamber and for said pressurized gas to impinge thereupon to saturate said liquid fuel with said gas.

6. A combustion engine fuel apparatus in accordance with claim 5 in which each said fuel saturation chamber inlet nozzle sprays a plurality of streams of fuel into said fuel saturator chamber through said pressurized gas therein.

7. A combustion engine fuel apparatus in accordance with claim 2 in which said fuel saturation chamber has a gas bleed line extending therefrom for excess gas to escape from said saturation chamber.

8. A combustion engine fuel apparatus in accordance with claim 7 in which said fuel diffusion chamber has a gas bleed line extending therefrom for excess gas to escape from said diffusion chamber.

9. A combustion engine fuel apparatus in accordance with claim 8 in which said saturation chamber gas bleed line and said diffusion chamber gas bleed line are connected to form a single gas bleed to atmosphere.

10. A combustion engine fuel apparatus in accordance with claim 7 in which said fuel saturation chamber gas bleed line has a check valve therein.

11. A combustion engine fuel apparatus in accordance with claim 8 in which said fuel diffusion chamber gas bleed line has a check valve therein.

12. A combustion engine fuel apparatus in accordance with claim 6 in which said fuel saturation chamber compressed has a gas inlet nozzle positioned to direct compressed gas into liquid fuel being sprayed thereinto.

13. A combustion engine fuel apparatus in accordance with claim 2 in which said compressed gas is compressed air.

14. A combustion engine fuel apparatus in accordance with claim 3 including a float switch mounted in said fuel saturation chamber and operatively connected to a valve in the fuel input to said fuel saturation chamber for releasing fuel into said fuel saturation chamber responsive to the fuel level in said fuel saturation chamber.

15. In a fuel treatment fuel system including a liquid fuel storage tank, a method for saturating liquid fuel with a gas comprising the steps of:

saturating liquid fuel from a fuel storage tank with a gas in a fuel saturating chamber;

directing said saturated liquid fuel from said fuel saturating tank into a fuel diffusion chamber;

diffusing a gas into liquid fuel received from said saturating chamber in a fuel diffusion chamber; and directing liquid fuel saturated and diffused with gas from said gas diffusion chamber into a combustion engine; whereby liquid fuel is saturated and diffused with a gas.

16. A method for saturating liquid fuel with a gas in accordance with claim 15 in which step of diffusing a gas into a liquid fuel includes diffusing a gas through a dense, porous material in said diffusion chamber by directing a liquid fuel on one side of said dense, porous material and a pressurized gas on the other side thereof for diffusion said gas into said liquid.

17. A method for saturating liquid fuel with a gas in accordance with claim 16 including the step of heating said liquid fuel prior saturating said liquid fuel.

18. A method for saturating liquid fuel with a gas in accordance with claim 17 in which the step of diffusing a gas through a said dense porous material includes diffusing a gas through a dense porous stone.

* * * * *